United States Patent [19]

Hirt

[11] 4,414,699

[45] Nov. 15, 1983

[54] MECHANICAL SWEEPER FOR ATTACHMENT TO A CARRIER VEHICLE

[75] Inventor: Max Hirt, Waldshut, Fed. Rep. of Germany

[73] Assignee: Ing. Alfred Schmidt GmbH, Fed. Rep. of Germany

[21] Appl. No.: 301,369

[22] Filed: Sep. 11, 1981

[30] Foreign Application Priority Data

Sep. 15, 1980 [DE] Fed. Rep. of Germany ..... 3034741

[51] Int. Cl.[3] ..... E01H 1/04

[52] U.S. Cl. ..... 15/87; 15/84

[58] Field of Search ..... 15/82–87, 15/340

[56] References Cited

U.S. PATENT DOCUMENTS 1,687,728 10/1928 Liddell ..... 15/87
4,160,302 7/1979 Hirst et al. ..... 15/87

FOREIGN PATENT DOCUMENTS 2326241 12/1974 Fed. Rep. of Germany ..... 15/340
2558029 7/1976 Fed. Rep. of Germany ..... 15/340
136989 8/1979 German Democratic Rep. .... 15/87

*Primary Examiner*—Edward L. Roberts
*Attorney, Agent, or Firm*—Brumbaugh, Graves, Donohue & Raymond

[57] ABSTRACT

A mechanical sweeper attached to a carrier vehicle comprises a sweeping assembly (2) which is attached laterally to the frame of a carrier vehicle (1) between the front and rear wheels. The sweeping assembly is attached as one unit to a carrier frame (26) which is movably connected to the vehicle in order to shift the sweeping assembly (2) into a position outside the lateral profile outline of the vehicle (1). In the case of a mechanical sweeper having an interchangeable body (6), which, on a body frame (8), includes devices for picking up and storing the dirt and is arranged as a whole above the rear wheels (4) of the carrier vehicle (1), the carrier frame (26) is fastened to the body frame (8) of the interchangeable body (6) so that it can be pulled out laterally. The lateral pulling out movement is facilitated by a supporting device which comprises a leg (11) fastened to the carrier frame (26), this leg being supported on the ground (9) by means of a support roller (12), on the side of the sweeping assembly (2) opposite the vehicle.

9 Claims, 2 Drawing Figures

MECHANICAL SWEEPER FOR ATTACHMENT TO A CARRIER VEHICLE

Figure 1:
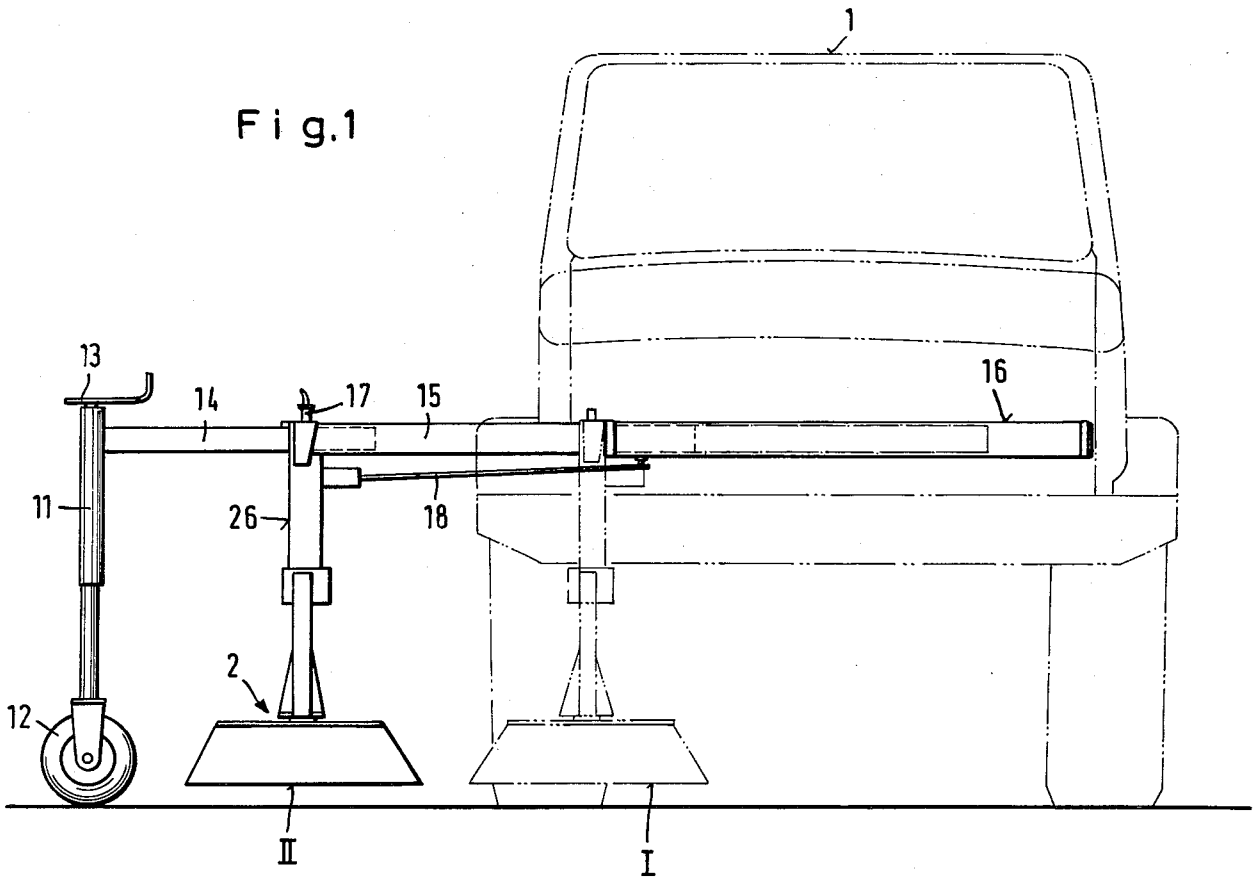

The invention relates to a mechanical sweeper having a sweeping assembly which, in the operative position, is arranged on the side of a carrier vehicle between the front and rear wheel.

Mechanical sweepers of this kind (for example as disclosed in German Offenlegungsschrift No. 27 51 423) are generally constructed as suction sweepers, that is to say, in addition to one or more brooms, they also have a suction shaft through which the sweepings are sucked into a dirt container. To ensure that the sweepings are reliably picked up, in addition to the suction shaft a blower shaft may be provided and this is located behind the suction shaft when viewed in the direction of travel. The current of air emerging from the blower shaft blows the loose dirt in front of the opening of the suction shaft. The type of brooms used are generally so-called circular brooms, but roller brooms may also be used. Suitable arrangement of several co-operating brooms means that the width to be swept can be enlarged. The mentioned components that serve to pick up the dirt form part of the so-called sweeping assembly which is detachably fastened to the side of the carrier vehicle between the front and rear wheel. In order to be able to carry out maintenance work, the sweeping assembly is removed in component parts, because these parts are inaccessible whilst attached to the vehicle.

The sweeping assembly is generally driven by sources of energy in the vehicle, that is to say, either by energy sources of the vehicle itself or of an additional externally mounted assembly, hydraulically-operated motors advantageously being provided to drive the brooms. The components of the sweeping assembly are moved by several pneumatic or hydraulic cylinders which are joined, for example, to the supply system of the vehicle. A separate fan is provided to operate the blower and suction shafts and it sucks the dirt through the suction shaft into a dirt container and forces a part of the sucked-in air through the blower shaft after the dirt has been filtered out.

It is also already well known to provide an interchangeable body on a vehicle that can be used for various applications, the mentioned assemblies for operating the sweeping assembly being housed in this interchangeable body together with a container for the dirt. The sweeping assembly itself is in it turn flange-mounted on the frame of the vehicle. To convert the carrier vehicle for a different job, the sweeping assembly and the interchangeable body have to be removed independently of one another from the vehicle. In the case of the interchangeable body this is effected using legs which may be extended telescope fashion and enable the vehicle to be driven away after raising the interchangeable body. The sweeping assembly that has been detached has to be shifted from the path of the vehicle before the vehicle can be driven away from the interchangeable body.

Compared with this, the present invention is based on the problem of simplifying maintenance of the sweeping assembly and its attachment to and removal from the carrier vehicle, and enabling these operations to be carried out more rapidly.

According to the proposal of the invention, with any carrier vehicle having a laterally arranged sweeping assembly this problem is solved by attaching the sweeping assembly as one unit to a carrier frame and by joining the carrier frame for shifting the sweeping assembly into a position outside the lateral profile outline of the vehicle movably to the vehicle.

The movable carrier frame proposed by the invention enables the sweeping assembly to be removed easily from the immediate vicinity of the vehicle to an outer position in relation to the profile outline of the vehicle. In such a position the sweeping assembly provides good access for maintenance work. Because the sweeping assembly is combined on one carrier frame its removal from the vicinity of the vehicle and thus its detachment from the vehicle is facilitated. The movement of the carrier frame can be effected as a linear pushing or pulling movement, or as a pivoting movement. The carrier frame can be supported on the frame of the vehicle or on another part joined to the vehicle frame.

In the case of a mechanical sweeper for attachment to a carrier vehicle which has an interchangeble body arranged on the vehicle frame above the rear wheels, a variation of the invention makes provision for the carrier frame with the sweeping assembly to be movably attached, for example hooked, to the framework of the interchangeable body (body frame) in such a manner that the interchangeable body can be shifted into a position outside the lateral profile outline of the vehicle. Such an assembly is especially advantageous because all components connected with the sweeping operation are thus fastened to the interchangeable body. When this is removed, it is no longer necessary to disconnect supply lines or drive connections to the sweeping assembly; this is first of all moved out of the working area between the wheels and the interchangeble body is then separated from the vehicle. The interchangeable body and the sweeping assembly are put down together. The empty carrier vehicle is available for other uses or for the attachment of other types of body.

An additional supporting device may facilitate the displacement of the sweeping assembly. The supporting device may be formed, at least partially, by the carrier frame, for example, by arranging that the carrier frame can be pulled out along a horizontal guide means together with the sweeping assembly.

Particular advantages are gained when the invention is applied to an interchangeable body which is designed as a framework having at least three, preferably four, legs that can be extended vertically. In this respect, the invention provides that one of the legs of the body frame can be fastened to the carrier frame and can be pulled out of the body frame together with the carrier frame. It is thus possible for the load of the sweeping assembly to be better distributed over the leg that can be pulled out laterally.

An advantageous arrangement provides that the carrier frame includes a guide part which is accommodated telescopically in a horizontal tubular transverse spar of the body frame.

Additional components and guide means can be dispensed with if the guide part of the carrier frame is constructed as a telescopic tube in which a horizontal strut of the leg fastened to the carrier frame engages.

Finally, an especially simple but very advantageous development provides that the guide part and the telescopic tube extend along the projection of the longitudinal axis of the transverse spar, and that the leg joined to the strut is supported on the ground by means of a support roller, on the side of the sweeping assembly opposite the vehicle.

This embodiment means that operation is especially easy when moving the sweeping assembly out of the area between the wheels. First of all, the strut of the leg provided with the support roller is inserted into the tubular guide part of the carrier frame and is secured there. When the connections between the interchangeable body and the vehicle frame have been released, all the legs are extended. The interchangeable body is lifted off the vehicle frame. The support roller of the leg anchored in the guide part of the carrier frame is braced against the ground; the guide part of the carrier frame is then drawn out as far as a limit stop by withdrawing the leg laterally out of the transverse spar of the body frame. The sweeping assembly is suspended on the guide part and on the strut of the leg travelling along the ground by means of its support roller. When the sweeping assembly is to be extended solely for maintenance work, it is not necessary to disconnect the flexible supply lines to the vehicle. These need be disconnected, for example by means of rapid-action couplings, only when the entire mechanical sweeper needs to be removed from the vehicle, and this can be effected very quickly.

If the blower and suction hoses are in the way when the vehicle is being driven away from beneath the interchangeable body, they can be disconnected from the sweeping assembly by releasing a pipe clip connection to the blower/suction mouthpiece and can be suitably pivoted out of the way when the carrier vehicle is driven out from beneath the interchangeable frame.

An embodiment of the invention is explained below with reference to the drawing.

Figure 2:
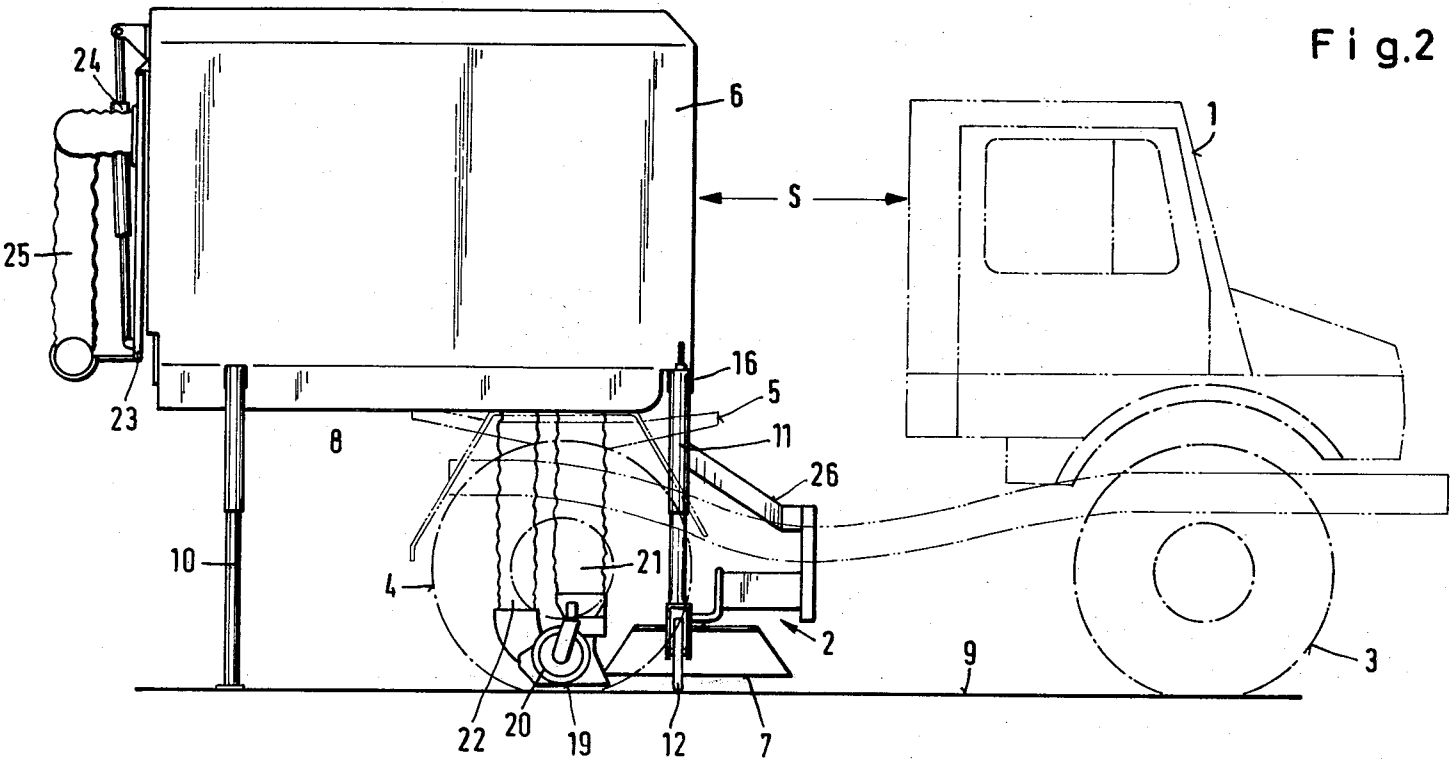

FIG. 1 shows a front view of a carrier vehicle with the sweeping assembly pulled out laterally, and FIG. 2 shows a side view of the carrier vehicle which has been partially driven out from beneath the interchangeable body.

As shown in FIGS. 1 and 2, the contours of the carrier vehicle 1 are drawn with dot-dash lines. A sweeping assembly 2 is arranged on one side of the carrier vehicle 1 between the front wheel 3 and the rear wheel 4 thereof. Moreover, an interchangeable body 6 is secured above the rear wheels 4 on a frame part 5 of the vehicle 1 and accommodates in its interior essentially a dirt container and a fan. In addition, inside the interchangeable body there are the oil-hydraulics for driving the circular broom 7 forming part of the sweeping assembly. An oil pump powered by the vehicle engine may also be used as the source for driving the circular broom (7). To simplify the drawings, the various compressed air cylinders for controlling the movement of the sweeping assembly (raising, lowering, pivoting), together with their flexible hose connections to the compressed air device on the vehicle, have not been drawn. The interchangeable body 6 rests on a body frame 8 which is supported on the ground 9 by four legs. Three of the legs 10 (two of which are hidden) are constructed as simple supports that can be adjusted telescopically in a vertical direction. A fourth leg 11 is allocated to the sweeping assembly and has a support roller 12 at its end nearest the ground, and at its top end, in the vicinity of the hand crank 13 which is used to extend the leg 11, it has a horizontal strut 14. The strut 14 is guided telescopically inside a horizontal guide part 15 of the carrier frame 26 of the sweeping assembly 2 and is locked by means of a socket pin 17. The guide part 15 in turn is guided telescopically in a horizontal transverse spar 16 of the body frame 8. According to FIG. 1, the sweeping assembly 2 is drawn with solid lines in the laterally extended mounting position (and with dot-dash lines in the retracted operative position). A cable 18 limits the maximum extent to which the guide part 15 can be drawn out of the transverse spar 16. Adjacent the circular broom 7, a flexible suction hose 21 and (viewed in the direction of travel) behind it a flexible blower hose 22 are joined to a blower/suction mouthiece 19 which is arranged behind the circular broom 7 of the sweeping assembly 2 and has lateral supporting wheels 20. The sweepings which have been sucked up pass through the suction hose 21 into a dirt container, behind which is arranged a fan which blows air out through the blower hose 22. The dirt picked up is collected in a dirt container and emptied at the rear of the interchangeable body after opening a trap 23 using a compressed air cylinder 24. A suction hose 25 on the rear of the interchangeable body may be used as an alternative to the suction hose 21. It is used in particular to empty drain holes, waste-paper bins or for picking up piles of dead leaves. In addition to the blower/suction mouthpiece 19 and the circular broom 7, the sweeping assembly 2 also includes further components for driving and for moving (raising, pivoting) the circular broom which have not been shown in detail in order to keep the drawing simple. The entire sweeping assembly 2 is suspended on the carrier frame 26.

In FIG. 1, the sweeping assembly is represented by dot-dash lines in the retracted operative position I and by solid lines in the extended position II which is suitable, for example, for carrying out maintenance work. The assembly is extended by inserting the leg 11 by means of the strut 14, which is secured inside the guide part 15 of the carrier frame 26 by the socket pin 17. After the leg 11 has been attached, it is extended vertically by turning the hand crank 13 until its support roller 12 at the end nearest the ground partially takes over the weight of the sweeping assembly 2. The carrier frame 26 can then be pulled out of position I into position II without substantial energy being expended, the leg 11 being moved in a lateral direction. In the extended position II, the sweeping assembly can be reached from all sides for maintenance work. The supply lines to the vehicle and the interchangeable body need be detached only if the entire interchangeable body is to be removed from the carrier vehicle. In that case, once the interchangeable body has been set down on all four legs and its connections to the frame part 5 of the vehicle have been released, the carrier vehicle 1 can be driven out from beneath the interchangeable body placed on the ground, as shown in FIG. 2. In this figure, the vehicle has already been moved away from the interchangeable body by the distance S. The sweeping assembly 2 which is located between the front and rear wheels in its operative position is no longer in the way of the rear wheels 4 once it has been extended laterally into position II. The vehicle 1 driven out from beneath the interchangeable body is empty of all assemblies and components connected with the mechanical sweeper and can be converted for other applications.

I claim:

1. Mechanical sweeper comprising a sweeping assembly arranged on a carrier vehicle having front and rear wheels, said sweeping assembly being attached as a single unit to and hence movable with a carrier frame, guide means for movably attaching said carrier frame to the vehicle, said carrier frame being movably attached to the carrier vehicle by said guide means for shifting the sweeping assembly into an inoperative position outside the lateral profile outline of the vehicle to facilitate servicing or removal of said sweeping assembly.

2. Mechanical sweeper comprising a sweeping assembly arranged on a carrier vehicle having front and rear wheels, said sweeping assembly, in the operative position, being arranged on the side of the carrier vehicle between the front and rear wheel, said sweeper further comprising an interchangeable body on a body frame arranged above the rear wheels of the carrier vehicle, said body including devices for picking up and storing dirt, characterized in that the sweeping assembly is attached as a single unit to and hence movable with a carrier frame, guide means for movably attaching said carrier frame to said body frame, said carrier frame, together with the sweeping assembly, being movably fastened to the body frame by said guide means in such a manner that the sweeping assembly can be moved into an inoperative position outside the lateral profile outline of the vehicle to facilitate servicing or removal of said sweeping assembly.

3. Mechanical sweeper according to claim 1 or 2, characterized in that the carrier frame, together with the sweeping assembly can be moved by means of a supporting device into a position outside the lateral profile outline of the vehicle.

4. Mechanical sweeper according to claim 3, characterized in that the supporting device is formed, at least partially, by the carrier frame.

5. Mechanical sweeper according to claim 4, characterized in that the guide means is a horizontal guide means and the carrier frame, together with the sweeping assembly can be pulled out along said horizontal guide means.

6. Mechanical sweeper according to claim 5, characterized in that the horizontal guide means includes a guide part which is accommodated telescopically in a horizontal tubular transverse spar.

7. Mechanical sweeper according to claim 6, characterized in that the guide part is constructed as a telescopic tube in which a horizontal strut is slidable, said strut being attached to a leg so as to at least partially support the sweeping assembly as it is moved into a position outside the lateral profile outline of the vehicle.

8. Mechanical sweeper according to claim 7, chracterized in that the guide part and the strut extend along a projection of the longitudinal axis of the transverse spar and the leg attached to the strut is supported on the ground by means of a support roller, on the side of the sweeping assembly opposite the vehicle.

9. Mechanical sweeper according to claim 2 wherein the body frame of the interchangeable body is designed as a framework having at least three legs that can be extended vertically, characterized in that one of the legs of the body frame can be fastened to the carrier frame and can be pulled laterally out of the body frame together with the carrier frame.

* * * * *